United States Patent [19]

Ditto

[11] Patent Number: 4,781,317

[45] Date of Patent: Nov. 1, 1988

[54] PHASING CONTROL SYSTEM FOR WEB HAVING VARIABLE REPEAT LENGTH PORTIONS

[75] Inventor: James W. Ditto, Golden, Colo.

[73] Assignee: Adolph Coors Company, Golden, Colo.

[21] Appl. No.: 923,675

[22] Filed: Oct. 27, 1986

Related U.S. Application Data

[63] Continuation-in-part of Ser. No. 902,192, Aug. 29, 1986.

[51] Int. Cl.[4] ..... B65H 23/04; B26D 5/34

[52] U.S. Cl. ..... 226/27; 83/74; 83/76; 226/29

[58] Field of Search ..... 226/27-31; 364/468-469; 101/181; 83/365, 269, 370, 367, 74, 76

[56] References Cited

U.S. PATENT DOCUMENTS

| | | | |
|---|---|---|---|
| 3,397,634 | 8/1968 | Betts et al. | 226/28 X |
| 3,556,509 | 1/1971 | Crum | 226/28 X |
| 3,559,568 | 2/1971 | Stanley | 226/28 X |
| 3,601,587 | 8/1971 | Thiede | 226/28 X |
| 3,774,016 | 11/1973 | Sterns et al. | 226/28 X |
| 3,802,306 | 4/1974 | Brown et al. | 83/76 X |
| 4,618,391 | 10/1986 | Torti et al. | 83/74 X |

FOREIGN PATENT DOCUMENTS

| | | |
|---|---|---|
| 1161525 | 1/1984 | Canada . |
| 2088100 | 6/1982 | United Kingdom . |

*Primary Examiner*—Stanley N. Gilreath
*Assistant Examiner*—Steven M. du Bois
*Attorney, Agent, or Firm*—Klaas & Law

[57] ABSTRACT

A method and apparatus for controlling the phasing of repeat length portions of a moving web to an operating machine along the web including method and apparatus for measuring instantaneous phasing error between web portions being operated on and the operating machine; method and apparatus for measuring repeat length error in web portions upstream of the operating station; method and apparatus for determining the total distance by which a web portion is out of phase with the operating machine before the web portion is operated on by the operating machine, method and apparatus for adjusting the movement of a web portion relative the movement of the operating machine during the last repeat length of web travel of the web portion before it is operated on by the operating machine; and method and apparatus for monitoring and correcting the phasing adjustment response.

9 Claims, 5 Drawing Sheets

PHASING CONTROL SYSTEM FOR WEB HAVING VARIABLE REPEAT LENGTH PORTIONS

The present application is a continuation in-part of U.S. patent application Ser. No. 902,192 filed Aug. 29, 1986 of James William Ditto for WEB INDICIA REFERENCE SIGNAL GENERATING SYSTEM.

BACKGROUND OF THE INVENTION

The present invention relates generally to control systems for phasing a moving web of material to operating machinery located at a fixed operating station along the web and, more particularly, a phasing control system which is adapted to be used in association with a web having repeat length portions which are to be phased to the operating machine which repeat length portions are subject to minor different length variations.

Web phasing systems have long been employed for phasing repeating longitudinal portions of a web having a constant repeat length to operating machinery along the web. For example, a web phasing system is used in a cutterline which cuts carton blanks having printed graphics thereon in order to ensure that the cut made by the cutter device is always made at approximately the same position with respect to the graphics of each repeat length of the web. A phasing device is necessary to ensure that a longitudinal misalignment of the web such as caused by slippage in web conveying rolls, a web splice, or the like, will not cause each of the repeat length portions occurring after such slippage, splice, etc. to be placed out of registry with the operating station machinery. If a significant misregistry of a web repeat length portion and an associated operating machine such as a web cutter does occur, all succeeding portions of the web which are effected by such misregistry must usually by scrapped. Thus, an accurate web phasing device is essential for any commercial high-speed operation in which repeat length portions of a web are operated on at one or more operating stations along the web. To control the phasing of a web with a particular operating station it is necessary to monitor the degree of registry of web repeat length portion with operating station machinery in order to make the necessary adjustments in the web movement or, in some cases, in the operating station machinery movement so as to ensure proper phasing of the web and operating stations. Such monitoring is generally performed by a photoelectric scanning device, generally referred to in the industry as a "photo eye" unit, which senses register marks on the web which are associated with each repeat length portion of the web. In an ideal control situation, the photo eye unit would be positioned within the operating station and would sense a register mark at exactly the time that the associated operation were being performed on the web. For example, in the case of a web carton blank cutting unit, the photo eye would be positioned within the cutter device and would sense a register mark on the web at exactly the same position that the cutter is designed to cut the associated web portion. In such a situation, a cutter position reference signal would also be generated at the time that the cutter was oriented in the cutting position. The cutter position reference signal and the web indicia signal would be compared by associated circuitry or other data processing means such as a computer to determine the degree of misregistry of the web with the cutter. However, in most situations, it is physically impossible to locate a photo eye unit in exactly the correct position within an operating station such that the operating station machinery position reference signal and the indicia sensing signal associated with a repeat length portion of the web being processed will occur at the same time in response to proper registry. In order to approximate a situation in which a web indicia signal will occur at the same instant as an operating station machine reference signal during proper registry, a register mark sensing unit is often placed at a position at an integer number of repeat lengths upstream of an associated operating station, for example, five repeat lengths away. In such a situation, even though the register mark associated with a repeat length which is being operated on by the operating station is not sensed at the same time that a machine reference signal is generated, a register mark which is then positioned beneath the photo eye unit will be sensed at that time, so long as the web repeat length distance remains constant throughout the web. However, a problem with such a sensing device placement system is encountered when web repeat length is subject to variation such as when the web being processed is a relatively extensible plastic film web. In such a situation, even a moderate increase or decrease in the repeat length of the web, e.g. $\frac{1}{4}$ inch in a 40 inch repeat length, will completely disrupt phasing control of the web because each succeeding repeat length error between the photo eye unit and operating station will produce an additive misregistry effect. Such misregistry will not be corrected by such a control system due to the erroneous assumption built into the control circuitry that the register mark associated with the subject operating station is located exactly the designed distance, e.g. five, repeat lengths from the register mark associated with the sensing device. To state the problem in a slightly different language, prior art phasing techniques phase a web to a point at an integer number of "ideal" or "design" repeat length distances upstream of an operating station and assume that this will produce proper phasing at the operating station as well. This assumption is incorrect when the actual repeat length distance of the web portions varies from the design repeat length value. The phasing error resulting from this incorrect assumption will be approximately equal to the amount by which the actual repeat length value varies from the ideal repeat length value multiplied by the number of repeat length distances that the photoeye unit is positioned away from the operating machine. To applicant's knowledge, no one in the industry appreciated this phasing problem associated with variable repeat lengths in extensible webs prior to applicant's identification of the problem.

Prior art phasing techniques are also inadequate for dealing with another type of problem encountered with extensible webs. The repeat length distance of extensible webs may vary nonuniformly from repeat length portion to repeat length portion. For example, one repeat length may be 0.1 inches long, the next may be 0.2 inches long, the next may be 0.1 inch short. Prior art techniques control phasing by controlling the position of a repeat length approaching a sensing unit on the phasing error measured in the preceding repeat length portion. Control is achieved by varying the speed of the web in proportion to the measured error. The control assumption underlying this technique is that the phasing error of the next repeat length will be approximately equal to the phasing error in the sensed repeat length. This assumption is invalid for webs having repeat lengths which are subject to variation from repeat length to repeat length and results in phasing error in addition to the phasing error associated with sensing device displacement from the operating station.

A need thus exists for providing a control system for use in phasing an extensible web to an operating machine which adequately accounts for variations in repeat length but which does not require sensing device to be physically located within an operating station at the point where an associated operation is being performed on a web.

OBJECTS OF THE INVENTION

It is an object of the present invention to provide a web position monitoring system having a sensing device portion which is located at a position along the web physically remote from a web operating station and which generates a reference signal which corresponds in time to the passage of a register mark past a fixed reference point within an operating station.

It is another object of the invention to provide such a monitoring system which produces a correct reference signal whether or not the actual repeat length of an associated web is at variance with the design repeat length of the web.

It is another object of the invention to provide such a monitoring system which may be used in association with other control components to provide proper phasing of a web having repeat length portions which are subject to minor variations in length.

It is another object of the invention to provide a control system which generates a control signal based upon the relative position of each repeat length portion in the last repeat length distance of web travel to the operating station.

SUMMARY OF THE INVENTION

The present invention achieves the above-described objectives by the use of a sensing device positioned at a predetermined distance of web travel upstream of a selected reference point within an operating station, by use of a web distance measuring device such as an encoder associated with a web roll positioned proximate the register mark sensing device, and by use of an operating machine cyclical position monitoring device such as an encoder. The sensing device register mark detection signal, the web travel signal and the machine position signal are input to a data processing device such as a minicomputer. The data processing device monitors the distance of web travel occurring subsequent to the generation of each pulse in a detection signal indicative of the presence of a register mark at the sensing device. At a point in time whereat this distance of web travel after each detection pulse is equal to the distance between the register mark sensing device and the selected reference point in the operating station, the data processing device generates a reference pulse which is provided in a separate reference signal. Thus, the pulses in this reference signal correspond in time with the passage of a register indicia past the reference point in the operating station. The reference pulses in this reference signal are compared to reference pulses in a machine position reference signal which occur at the point in time when a register mark is positioned at the operating station register point when the web is in proper registry with the operating station. Variations in the occurrence between the operating station machine position reference signal and the indicia reference signal generated by the data processing means thus accurately reflect the amount be which the web is out of phase with the operating station. The register mark detection signal and web travel signal are also used to determine the actual repeat length of each web portion. This actual repeat length is compared to the design repeat length to determine a repeat length error. The measured phasing error of a repeat length currently in the operating station is added to the repeat length error of the repeat length portion which is immediately upstream of the operating station and this total error value is used as the basis for adjusting the speed of the web during the period that the next repeat length moves from a position approximately one repeat length from the operating station to a registry position in the operating station. As the subject repeat length moves toward the operating station, the relative amount of correction of the total error value that has been performed is calculated by comparing the web travel signal to the machine position signal. The control signal is adjusted based on these comparisons.

Thus, the present invention may comprise an apparatus for controlling the phasing of repeat length portions of a moving web to an operating machine at an operating station along the web wherein the operating machine has a repeating operating cycle and is designed to perform the same operation on each repeat length portion of the web passing through the operating station and wherein the web is of the type which is subject to minor variations in the length of the repeat length portions thereof, comprising: (a) register indicia means associated with each repeat length portion of the web positioned at a substantially identical location within each repeat length portion of the web for sensing by a register indicia sensing means for indicating the relative position of an associated repeat length portion; (b) register indicia sensing means positioned at a sensing station along the web at a preselected distance of web travel upstream of the operating station for sensing the passage of said register indicia at said sensing station and for providing a register indicia sensing signal indicative thereof; (c) web travel monitoring means operatively associated with the web for providing a web travel signal indicative of web travel distance; (d) machine reference position sensing means for sensing the occurrence of a cyclically repeating reference position of said operating machine and for providing a machine position reference signal indicative thereof; (e) operating machine movement sensing means for providing a machine movement signal indicative of the relative cyclical machine movement of said operating machine; (f) data processing means for receiving and processing said web register indicia sensing signal, said web travel signal, said machine reference position signal, and said machine movement signal and for generating a control signal for controlling the relative rate of movement between said web and said operating machine based on said processing of signals for placing each repeat length portion of the web in proper registry with said operating machine; wherein said data processing means comprises web repeat length calculating means for calculating the length of each repeat length portion of the web prior to its passage through the operating station; repeat length error determining means for comparing said calculated length of each repeat length portion to a predetermined, constant, design repeat length value for determining the relative repeat length error occurring in each repeat length portion; register indicia reference signal generating means for generating a signal indicative of the passage of a register indicia past a fixed point associated with said operating station at a predetermined distance of web travel downstream of said indicia sensing means; phasing error determining means for comparing said register indicia reference signal to said machine position reference signal for measuring the phasing error between a web repeat length portion and the operating machine during each operating machine cycle; and error summing means for summing a determined phasing error associated with one repeat length portion with the determined repeat length error in the next succeeding repeat length portion for determining an initial total error value for the repeat length portion immediately upstream of the operation station; wherein the control signal generated by said data processing means is based upon said determined total error value associated with the repeat length portion immediately upstream of the operating station; wherein said data processing means monitors and compares at frequent intervals said web travel signal and said machine motion signal during the movement of a web repeat length portion from a position approximately one repeat length upstream of the operating station to a position associated with machine registry in said operating station whereby the relative amount of correction of said total initial error value determined for a repeat length portion is calculated at frequent intervals; and wherein said control signal is adjusted at frequent intervals based upon said relative amount of correction of said initial total error value wherein a relatively gradual web velocity change is provided in response to said control signal.

The invention may also comprise a method for controlling the phasing or repeat length portions of a moving web to an operating machine at an operating station along the web wherein the operating machine has a repeating operating cycle and is designed to perform the same operation at the same relative position within each repeat length portion of the web passing through the operating station and wherein the web is of the type which is subject to minor variations in the length of the repeat length portions thereof, comprising: (a) providing register indicia on the web in association with each repeat length; (b) sensing the passage of a web register indicia at a predetermined sensing location upstream of the operating station; (c) continuously measuring the distance of web travel occurring after the sensing of said register indicia at said sensing station and at frequent intervals determining the relative distance of said sensed register indicia from said operating station based upon said measured distance; (d) monitoring the relative cyclical position of said operating machine (e) comparing said monitored cyclical machine position with said determined register indicia position at frequent intervals during the last repeat length distance of web travel before said register indicia is positioned in a registration position with said operating machine; (f) adjusting the relative velocity between the movement of said web and the cyclical movement of the operating machine based upon said comparison of machine position and register indicia position at frequent intervals during said last repeat length distance of movement of said register indicia so as to position said register indicia at a predetermined fixed reference point in said operating station at the same time as the occurrence of a predetermined cyclically repeating machine operating position.

The invention may also comprise a method for controlling the phasing or repeat length portions of a moving web to an operating machine at an operating station along the web wherein the operating machine has a cyclically repeating operating cycle and is designed to perform the same operation at the same relative position within each repeat length portion of the web passing through the operating station and wherein the web is of the type which is subject to minor variations in the length of the repeat length portions thereof, comprising: (a) providing register indicia on the web in association with each repeat length; (b) sensing the passage of each register indicia at a sensing station located a predetermined distance of web travel upstream from an indicia registration point in said operating station associated with a predetermined, cyclically reoccurring operating machine state and generating a register indicia sensing signal indicative of the sensing of register indicia at said sensing station; (c) providing a web travel signal indicative of the distance of web travel; (d) determining the point in time at which a register indicia is coincident with said operating station registration point by determining the point in time at which the web travel distance occurring after the sensing of an indicia at said sensing station is equal to said predetermined web travel distance between said sensing station and said operating station registration point through the use of said sensing signal and said web travel signal and generating a web indicia registration signal indicative of said coincidence between a web register indicia and said operating station registration point; (e) continuously monitoring the relative cyclical state of said operating machine including monitoring the occurrence of a machine reference state which occurs at the time a register indicia is located in coincidence with said operating station reference point during proper registration of said web and said operating machine; (f) determining the web phasing error distance associated with each repeat length portion of the web by measuring the distance of web travel occurring between the point in time of coincidence between a register indicia and the operating station registration point and the point in time of the occurrence of said machine reference state; (g) determining the length of each repeat length portion by determining the distance of web travel occurring between a first sensed indicia and the next sensed indicia using said indicia sensing signal and said web travel signal; (h) determining the repeat length error distance associated with each repeat length portion of the web by comparing the measured repeat length distance thereof to a predetermined design repeat length value and calculating the difference; (i) determining the total web travel adjustment needed for proper phasing of a repeat length portion with the operating machine when the repeat length portion is positioned one repeat length upstream of the operating station by adding the repeat length error distance associated with that repeat length portion to the phasing error distance associated with the immediately preceding repeat length portion; (j) adjusting the speed of the web relative the speed of the operating machine to provide said web travel adjustment; wherein step (j) comprises monitoring the relative amount of web travel adjustment that has been made at frequent intervals during the last repeat length of web travel upstream of the operating machine and adjusting web speed in relatively small increments during said last repeat length of web travel to provide an accurate and relatively constant rate speed adjustment of said web during said last repeat length of web travel whereby said web is not subjected to substantial inertial forces.

DETAILED DESCRIPTION OF THE INVENTION

Figure 1:
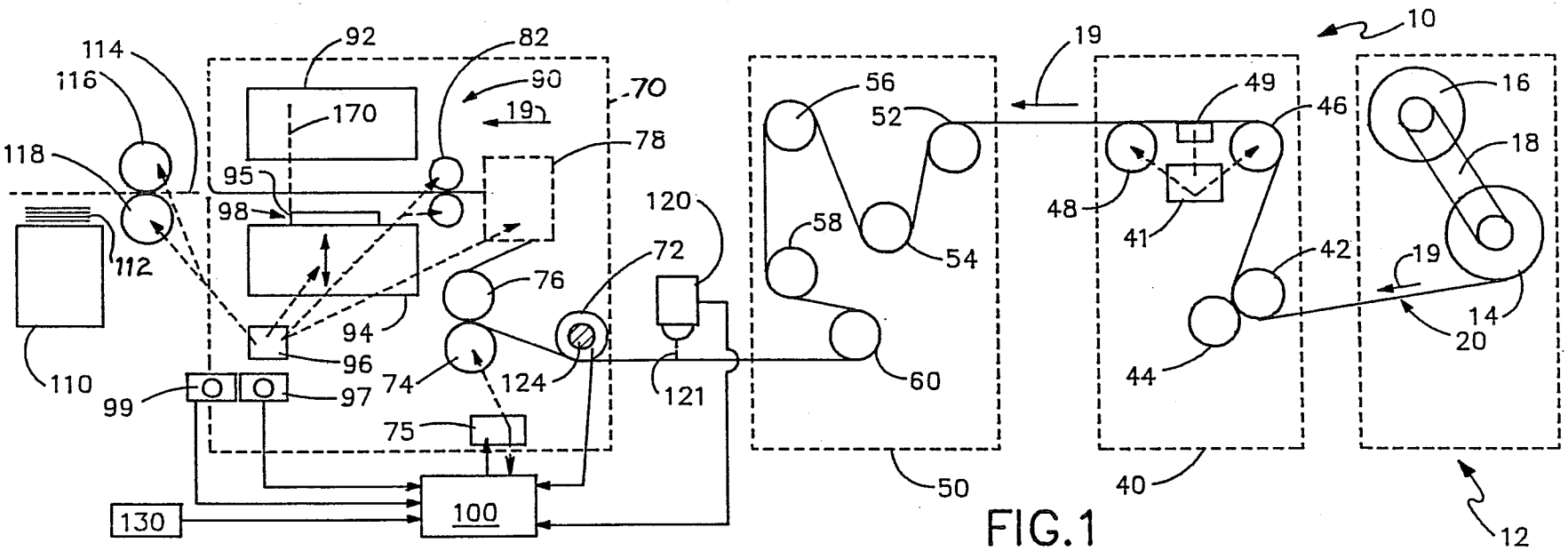
FIG. 1 is a schematic illustration of a continuous web and various operating stations used in processing thereof in which the control system of the present invention is utilized.

The sensing device signal correction system of the present invention may be used in a cutterline 10 as illustrated in FIG. 1. The cutterline comprises a series of different areas for performing operations on a continuous web of material resulting in the cutting of predetermined portions of the continuous material web 20 to form a plurality of individual cut blanks 112.

Figure 2:
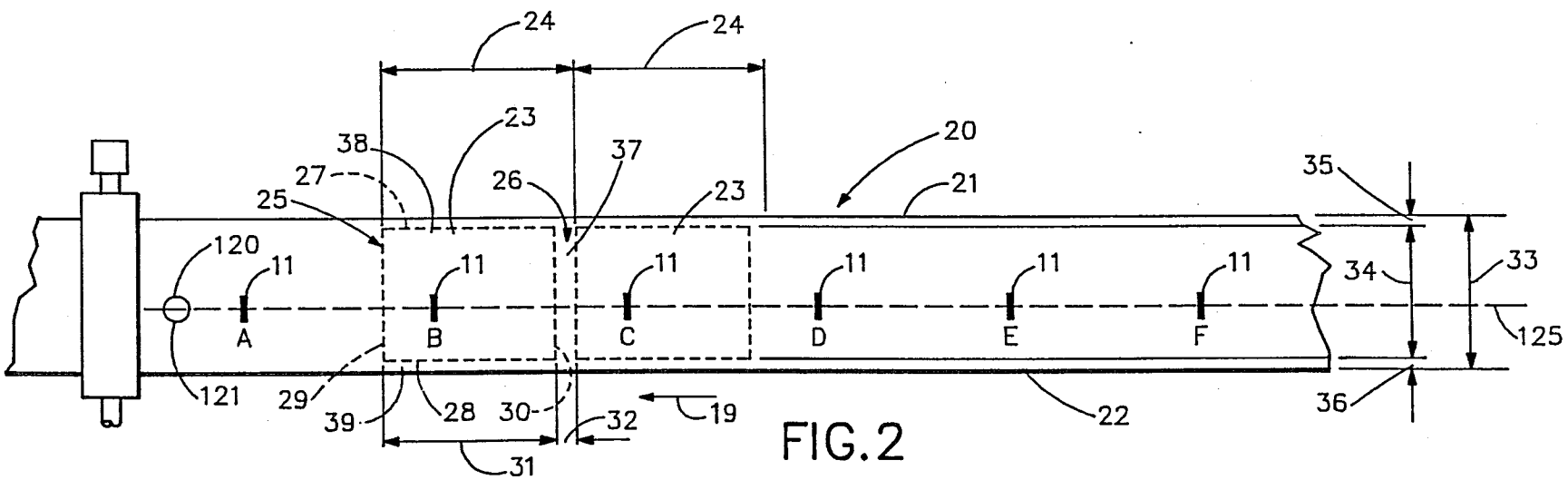
FIG. 2 is a top view of the web of FIG. 1.

The material web 20 moves through the machine in a longitudinal direction 19. As illustrated in FIG. 2, the web 20 comprises a pair of parallel lateral edges 21, 22. A repeating pattern of graphics 23 including register marks 11 designated individually as A, B, C, D, etc. are printed on the web 20 and repeat at predetermined substantial constant distance intervals along the web hereinafter referred to as the "repeat length" 24. Small variations in the repeat length may occur due to tension changes, etc. in the moving web. Within each repeat length 24 is a design cutting location 25, 26, etc. The "design cutting location" refers to the location of the cut which the cutter 98 will cut in the web if the system is operating correctly. The design cutting location thus has a preset relationship with respect to the graphics and associated register indicia 11 in any repeat length of web material. It will be appreciated that this design cutting location may vary from the actual cut made in each repeat length if the web is not properly longitudinally phased and laterally aligned with the cutter. In the embodiment described the shape of the design cut is rectangular and comprised lateral edges 27, 28 positioned generally parallel the web lateral edges 21,22 and also comprises a leading edge 29 and a trailing edge 30 positioned generally perpendicular the lateral edges of the web. Each repeat length 24 comprises the longitudinal dimension 31 of the design blank pattern i.e. the length of the pattern and may also comprises the longitudinal dimension 32 of a portion of the web 37 positioned between the design cuts 25, 26 which becomes scrap subsequent to the cutting of the web. This scrap portion 37 is preferably kept to a minimal size and in some applications may be entirely eliminated. The lateral dimension or width of the web 33 comprises the lateral dimension 34 of the blank cutting pattern and the lateral dimension 35, 36 of the portion of the web 38, 39 positioned outwardly of the design cut which will also become a portion of the scrap after the web is cut and which is also preferably kept to a minimal size.

The first station of the cutterline 10 is an unwind stand 12 at which an unwind roll 14 and a reserve roll 16 are mounted on a conventional yolk 18. Each of the rolls 14, 16 comprises a wound continuous web of material such as paper, plastic film, paper-film composite, or the like. A typical roll of material may have a width of 44 inches and a maximum diameter of 80 inches and may weigh on the order of 2½ tons. The material web 20 is pulled from the unwind roll 14 until the roll is exhausted. The trailing edge of the web roll 14 is then spliced to the leading edge of material on the reserve roll 16 at which point the reserve roll becomes the unwind roll and another roll is mounted on the yolk 18 in place of roll 14. Such unwind and splicing operations are conventional and well-known in the art. The continuous web 20 is drawn from the unwind roll 14 by a pair of pinch rolls 42, 44 located in a decurl unit 40 which may also be used in the web splicing operation. Subsequent to passing through the pinch rolls 42, 44 the web 20 passes over decurl rolls 46, 48 which take out some of the curl which sets into a roll of material over the period in which it is in storage. The decurl rolls may also be used for lateral alignment of the moving film web 20. The rolls 46, 48 are mounted on a frame which may be tilted from side to side to shift the web laterally as it crosses the rolls to maintain the web in a proper lateral position. A web edge sensor assembly 49 is used to determine the lateral position of an edge portion of the film web and, based upon this determination, provides a signal to a hydraulic drive unit 41 which tilts the frame supporting rlllers 46, 48 in response to the signal to maintain the web 20 in a laterally centered location in decurl unit 40. Subsequent to passing through the decurl unit 40 the web may pass into a string insertion unit 50 in which strings may be glued onto the web to increase web strength. The actual assembly for string insertion may be of the type illustrated in U.S. Pat. No. 4,496,417 of Haake et al which is hereby incorporated by reference. The web passes over a series of rolls 52, 54, 56, 58, 60 in the string insertion unit. After leaving the string insertion unit 50 the web 20 passes into a cutter creaser assembly 70 which comprises a plurality of rolls including idler roll 72 and metering nip rolls 74, 76 driven by variable speed motor 75. Variations in motor 75 speed may be produced by a mechanical correction motor and differential assembly (not shown) or by direct electronic command to motor 75. Both methods of speed control are well-known and commonly practiced in the art. After leaving metering nip rolls 74, 76 the web passes into a moving curved plate assembly 78 of a type known in the art. The web next passes through driven cutter feed rolls 82, 84 prior to entering a cutter unit 90 comprising an upper fixed cutter portion 92 and a lower reciprocating cutter portion 94 which is caused to reciprocate at a constant speed by a cutter drive motor 96. Fixed knives 98 mounted on the lower reciprocating cutter portion 94 have the same configuration as the design cut 25, 26. Knives 98 have a leading edge 95 which corresponds to leading edge portion 29 of a design cut. Subsequent to being cut the web passes into driven exit roll nip 116, 118. Feed rolls 82, 84 and exit rolls 116, 118 operate simultaneously and are rotated and stopped periodically such that the web portion positioned therebetween is stationary when cut. The portion of the web between rolls 82, 84 and rolls 74, 76 is taken up by curved plate assembly 78 during the period when rolls 82, 84 and 116, 118 are stopped to maintain a relatively constant tension in that web portion. However, the total distance of web travel between metering rolls 74, 76 and cutter blades 98 remains at an effectively constant value from one repeat length cutting operation to the next.

Rolls 82, 84; curved plate assembly 78 and rolls 116, 118 are operated by conventional cam timing devices associated with a driven shaft portion of cutter motor 96. A cutter encoder 97 is also driven by a shaft associated with cutter motor 96 and produces a signal which is proportional to the angular displacement of the cutter motor shaft. A cutter shaft reference position signal generator 99 also driven by the cutter motor shaft produces a single pulse signal during each cycle of operation of the cutter which is indicative of a cyclically repeating cutter position which in one preferred embodiment is the bottom of the cutting stroke. Subsequent to being cut by the cutter unit 90 the web passes over a delivery table 110 where cut blanks 112, in the shape of design cuts 25, 26, etc., formed in the cutting operation are caused to be deposited on the delivery table in stacked relationship. Operating personnel periodically remove the stacked blanks 112, placing the blanks on pallets, etc. for subsequent transport to other machinery for further forming operations such as folding. The cutter unit 90 and stacking table 110 assembly may be of a conventional type well-known in the art. For example, the cutter unit may be model no. Z714 manufactured by Zerand of New Berlin, Wis.

A central control problem solved by the present invention is the longitudinal phasing of a web 20 to a cutter 90 to ensure that the cutter cuts the web precisely at the design cuts 25, 26 rather than at some other longitudinal position which is longitudinally misaligned with the graphic 23 in each repeat length 24. The apparatus for providing longitudinal monitoring and control of the web 20 will now be described.

As shown by FIG. 2, a series of longitudinally spaced-apart laterally extending register marks are repeated at approximately equal repeat length intervals along the film web 20. The marks are positioned in a predetermined fixed relationship relative the repeating graphics and associated design cuts 25, 26 on the web 20 and are also located in generally fixed relationship between the lateral edges 21, 22 of the web 20. The marks 11 extend laterally of the web and are in longitudinal alignment with respect to the web such that all of the marks will be detected by a single mark detection unit positioned at a fixed location above the web and defining a longitudinally extending mark detection path 125. In the embodiment illustrated in FIG. 1, a conventional photo eye assembly 120 is positioned between the mark detection string insertion assembly 50 and the cutter assembly 70 at a location 121 a predetermined known distance of web travel from the cutter unit 90. An encoder unit 124 which generates a predetermined number of electronic pulses per revolution of an associated roller is mounted on roller 72 immediately downstream of photo eye assembly 120. The roller 72 engages the web 20 passing thereover in non-slipping contact and thus the number of pulses from encoder 124 during any particular time interval is linearly proportional to the distance that web 2 has travelled during that time interval. A data processing unit 100 (which may include a conventional microcomputer or minicomputer with appropriate control software and electronics) receives signals from the encoders 97, 124, photo eye 120, cutter position signal generator 99, and also receives a motor speed indicating signal from metering roll drive motor 75. An input terminal means such as keyboard 130 is provided to enable operator input of certain values particular to a web being run, etc.

Figure 3:
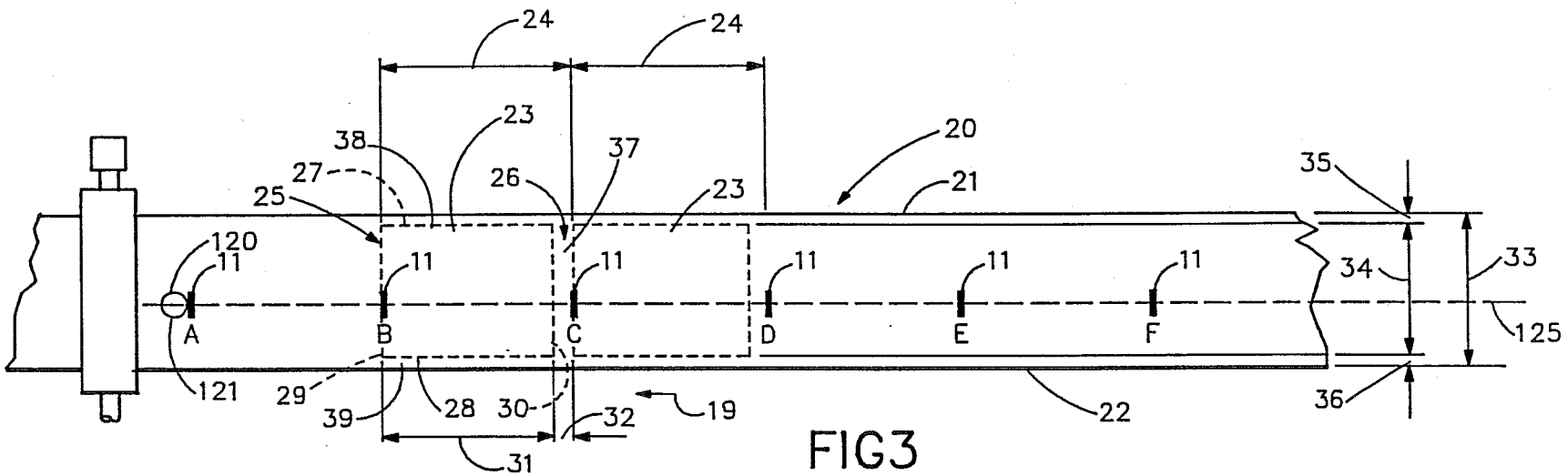
FIG. 3 is another embodiment of the web of FIG. 1.
Figure 4:
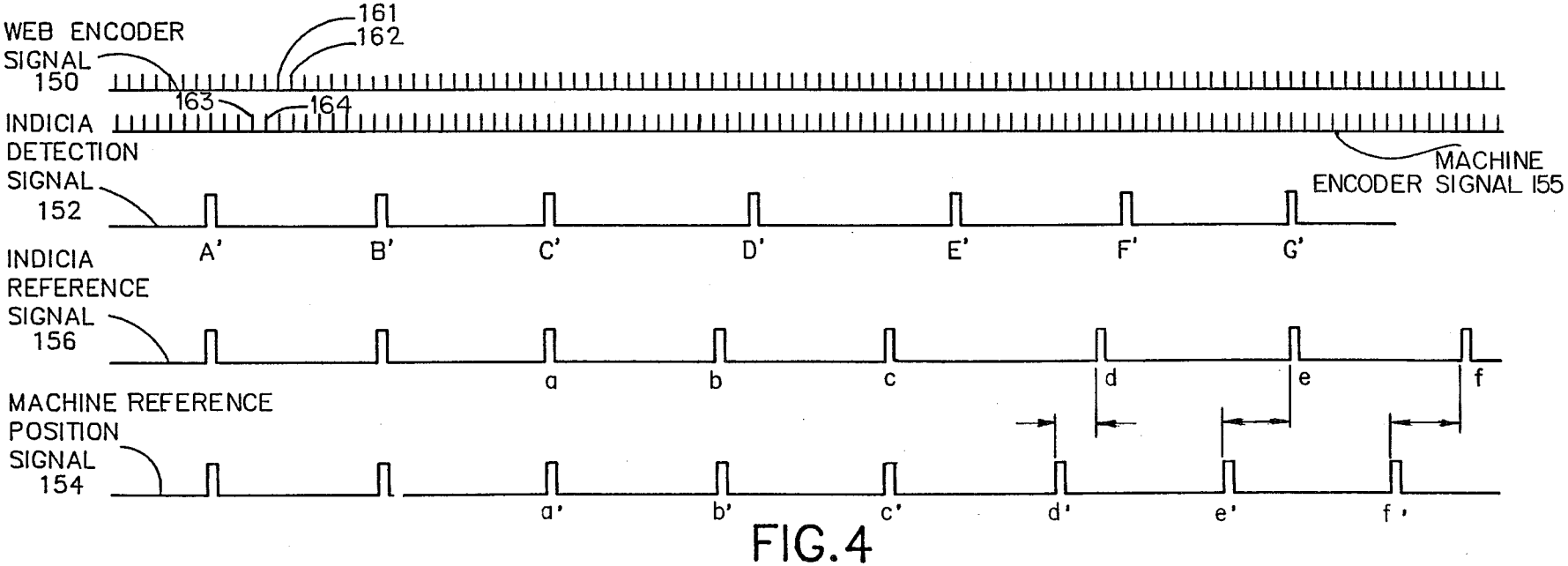
FIG. 4 is a schematic view of certain signals generated by the control system of FIG. 1.

Operation of the web indicia reference signal generating portion of the control system of the present invention will now be described. FIG. 4 illustrates electronic pulse signals provided by web encoder unit 124, photo eye unit 120, cutter position indicating signal generator 99, cutter movement encoder unit 97, and data processing unit 100 at 150, 152, 154, 155 and 156, respectively. The horizontal dimension of FIG. 4 represents time. Relatively few encoder pulses 161, 162, 163, 164, etc. per unit of length are shown to avoid cluttering the drawing, however, it is to be understood that in an actual production unit a high resolution encoder generating several hundred pulses per inch of web travel and per each 0.01% of machine cyclic movement would be used to obtain precise phasing control. To further simplify the explanation, an embodiment of the system in which the register mark 11-A, 11-B, 11-C, 11-D, etc. in each repeat length is positioned in coincidence with the leading edge 29, etc. of an associated design cut will be described with reference to FIG. 3. In the described embodiment, the position of photo eye unit 120 is two repeat lengths of web travel from the leading edge 95 of cutter knives 98.

The encoder pulse signal 150 from web encoder 124 and the indicia detection signal 152 from photo eye unit 120 are both input to the data processing unit 100. The rectangular shape of each detection signal pulse A', B', C', D', E', F', G', etc. is indicative of the sensing of a dark region on the web provided by an associated register mark A, B, C, D, etc., respectively. The leading edge of each pulse is preferably used as the reference position in web travel measuring operations described below. Appropriate software and/or circuitry is provided in processing unit 100 for the functions described below and the provisions of such software and/or circuitry is within the level of skill of a person with ordinary skill in the art.

Processing unit 100 measures the distance of web travel occurring after each pulse A', B', C', D', etc. in the indicia detection signal 152 by counting the web encoder pulses occurring after each of the pulses A', B', C', D', etc. This encoder pulse counting procedure continues until a number of encoder pulses is reached that is the equivalent of the distance between the photo eye unit sensing position 121 and a predetermined longitudinal position 170 within the cutter 90 which in the illustrated embodiment is opposite the leading edge portion 95 of the cutter blades 98. As previously mentioned, photo eye position 121 in the described embodiment is chosen such that the distance of web travel between position 121 and 170 is two ideal repeat lengths 24. However, any distance which positions unit 120 reasonably close to cutter assembly 70 may be used. The processing unit 100, after counting a number of encoder pulses equal to the web distance between 121 and 170 (two ideal repeat lengths), generates a pulse in reference signal 156. In the illustrated embodiment, reference pulses a, b, c, d, e, f, g, etc. in indicia reference signal 156 correspond to detection signal pulses A', B', C', D', E', F', G', etc., respectively. Since photo eye sensor unit 120 is positioned two ideal repeat lengths of web travel upstream of cutter station 170, reference signal pulses a, b, c, d, etc. occur at the same time that the marks A, B, C, D, etc. which produced detection signal pulses A', B', C', D', etc. are located at station 170, i.e. when register indicia A associated with design cut unit 25 is sensed by unit 120 it produces detection pulse A' and, after the web has travelled two ideal repeat lengths such that mark A is positioned at 170, a pulse "a" is produced by processing unit 100. In the embodiment illustrated, the actual repeat length between adjacent marks AB, BC, EF and FG are each equal to the ideal repeat length 24 but the repeat length between marks CD and DE are 20% longer than the ideal repeat length. Such a large variation in repeat length is unlikely in an actual operating system but is shown here to facilitate the description of the invention. A cutter reference position indicating signal 154, which is preferably produced by an encoder associated with a rotating motor shaft of the cutter unit, is provided which occurs at the time the cutter begins its cut. This machine position thus corresponds to points in time when the leading edge 29 of each design cut 25, 26 etc. would be positioned at station 170 for properly phased cutting. The machine reference pulse signals which are output when the cutter is at the bottom of a cut are represented at a', b', c', d', e', f', g', etc. These pulses coincide in time with reference pulses a, b, c, d, etc., respectively, when the web is properly phased to the cutter. As shown by FIG. 4, machine position signal pulses d', e', f' and g' are out of phase with indicia reference pulses d, e, f because of the repeat length error in web portions DE and EF. The amount of this phasing error is determined by processing unit 100 by counting the web encoder pulses occurring between associated pairs of pulses dd', ee', ff'.

Figure 6A:
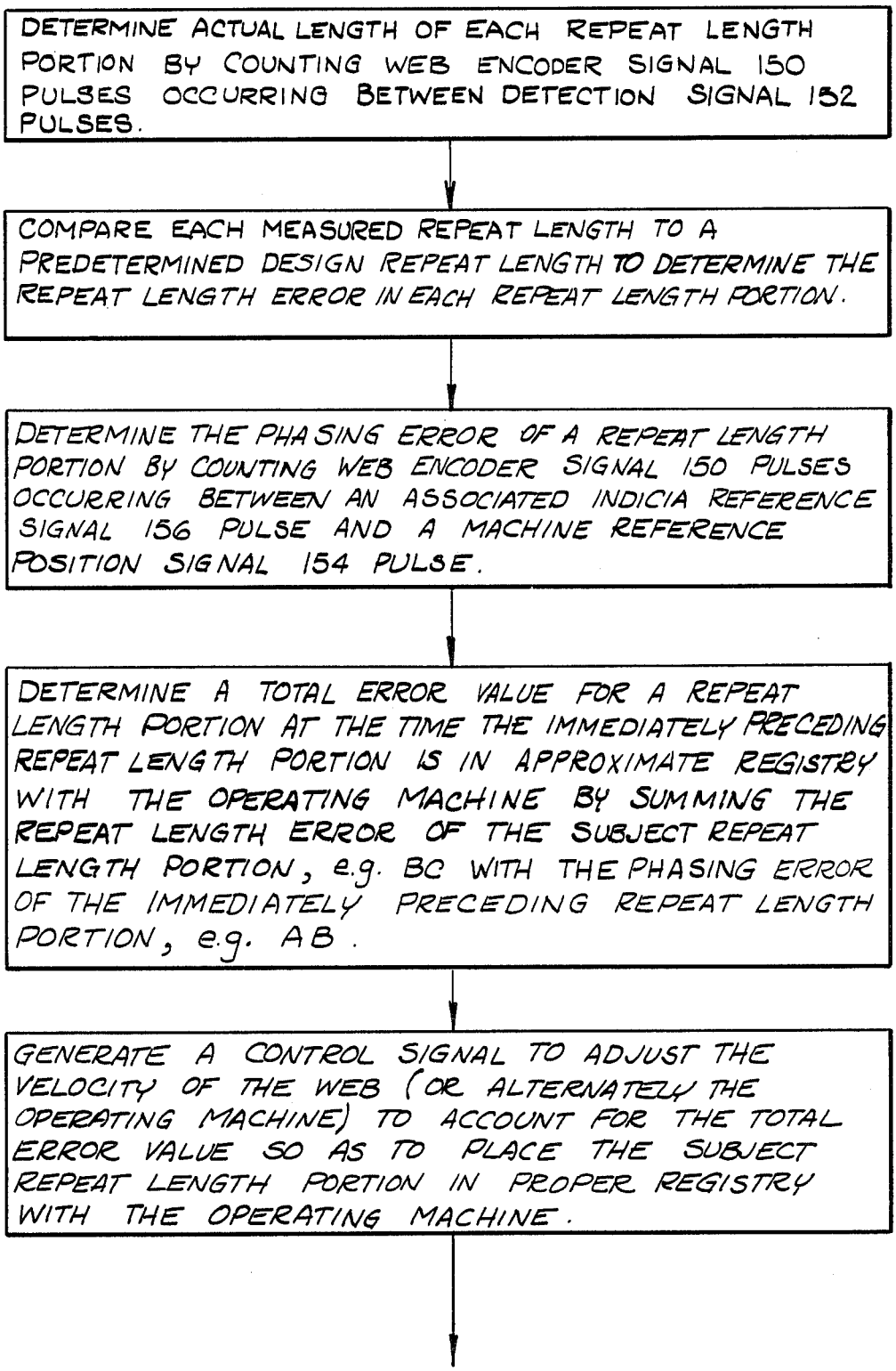
FIGS. 6A and 6B form a single block diagram illustration of one method of operation of a web registration control system.
Figure 6B:
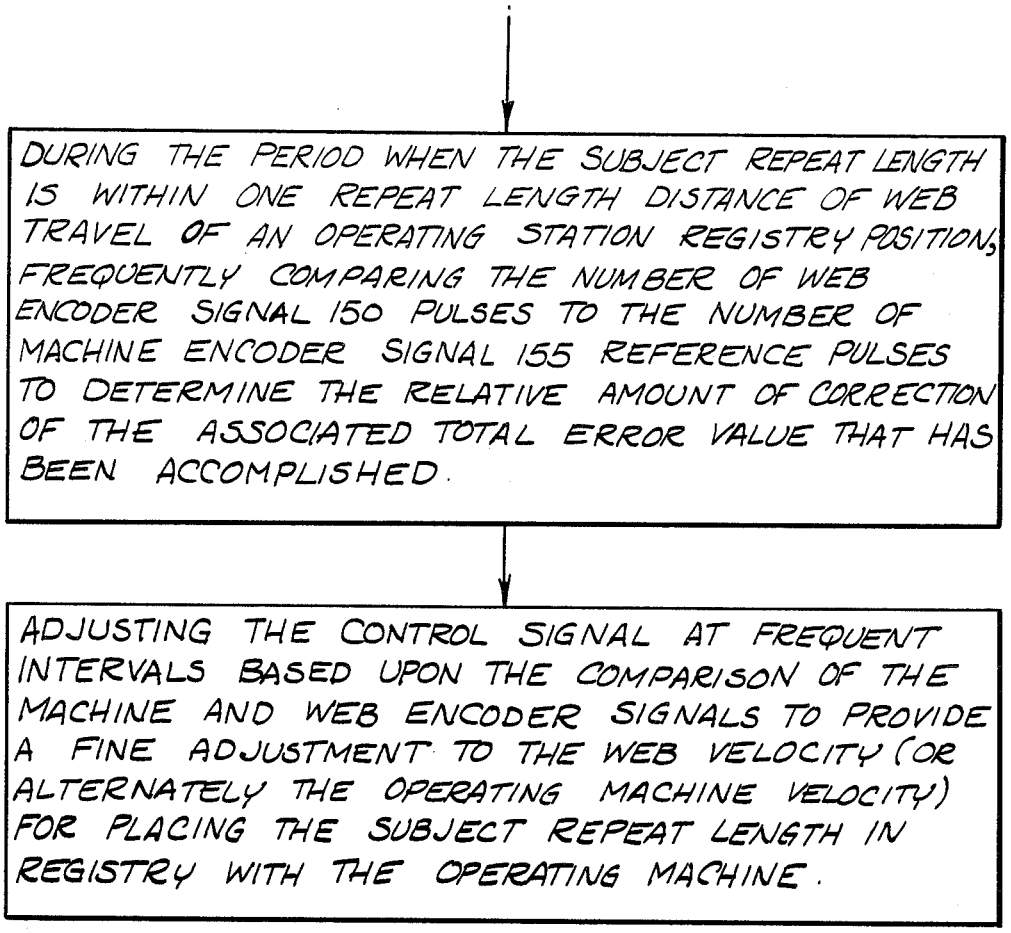

In the example illustrated in FIG. 4, the control portion of the system is not in operating and thus a control signal to correct this measured phasing error has not been produced. The method of operation of the phasing and repeat length error control system of the present invention is shown in FIG. 6. The repeat length error in each repeat length portion is determined by counting the number of web encoder pulses occurring between the detection of reference indicia positioned at the beginning and end of each repeat length, e.g. the repeat length distance of web portion BC is determined by counting the number of encoder pulses occurring between indicia detection signal pulses b' and c'. These measured repeat length values are then compared to the design repeat length value and a repeat length error value is determined. The repeat length error value will be given a positive or negative value depending upon whether the actual repeat length value is more or less than the design repeat length value and depending upon the sign convention used in the control software. The repeat length error value for each repeat length portion is then stored in computer memory.

Even when the control system is operating, there will be small phasing errors occurring between some of the repeat lengths and the operating machine due to control inaccuracies caused by control linkage variables, control lag times, etc., which may not be entirely eliminated from the system. A phasing error for each repeat length portion of the web is measured by counting the number of web encoder pulses occurring between an associated indicia reference signal 156 pulse, e.g. c, and a machine reference position signal 154 pulse, e.g. c'. This phasing error value will be assigned a positive or negative value depending upon whether the indicia reference signal pulse occurred before or after the machine reference position pulse, and depending upon the sign convention used in repeat length error determinations.

A total error value for a subject repeat length which is positioned approximately one repeat length of web travel distance upstream of registry position with the operating station is determined by adding the repeat length error of the subject repeat length to the phasing error of the repeat length portion immediately preceding the subject repeat length. This total error value is calculated immediately after the phasing error of the immediately preceding repeat length portion is measured. Thus, the total error value for a subject repeat length portion is representative of the distance that a subject repeat length portion is out of phase with the operating machine when the subject repeat length portion is positioned approximately one repeat length away from the operating machine. Based upon the total error value determined for the subject repeat length, and based upon the actual position of the subject repeat length with respect to a registration position in the operating station, a control signal is generated to vary the web velocity so that the subject repeat length will be placed in proper registry with the operating machine when the subject repeat length is at the reference position within the operating station. Control algorithms for making such velocity adjustments are known in the art and may comprise, for example, a proportional, integral, differential (PID) control algorithm or other algorithms. The PID algorithm, which is presently preferred, varies velocity of the web throughout the entire repeat length distance of web travel occurring between the time that the control signal for a subject repeat length portion is generated and the time the subject repeat length portion is registered with the operating machine. Such a gradual velocity adjustment prevents the web from being subject to udue inertial forces which may have a tendency to distort the web, especially if an extensible plastic film web or the like is being used.

If all control linkages and machine responses were perfect, no further control of the web would be needed. However, due to inaccuracies inherent in any control system, the above-described control function by itself would not provide precise registration between the web repeat length portions and the operating machine. Thus, the control system is provided with a fine adjustment feature to further control the phasing operation. This fine adjustment feature involves comparison of the web encoder signal 150 to the machine encoder signal 155 to determine the relative amount of correction that has been accomplished by the coarse control signal adjustment. These encoder signal comparisons are made at frequent intervals, e.g. after every ½ inch of web travel or more frequently depending upon the speed of the computer and resolution of the encoders. After each comparison of encoder signals, the relative amount of total error value correction that has been accomplished is determined. The control signal is thereafter further adjusted depending upon whether the amount of total error value that has been corrected is above or below or exactly at the point where it should be in relationship to the total distance of web travel that has occurred since the initiation of control for the subject repeat length. Such frequent updating of the control signal thus provides a much more accurate phasing control than could be accomplished by the coarse mode operation by itself.

It will of course be appreciated that, instead of controlling the web velocity with respect to a constant operating machine movement rate, the operating machine movement rate could be controlled with respect to the web velocity to accomplish the same result. Due to the relatively great inertia associated with the operating machine, it is generally easier to control the web velocity. However, in situations such as described below with respect to FIG. 5 in which the machine inertia is relatively small, it may be preferable to control operating machine speed with respect to web movement.

A web having a configuration in which each register mark 11 is positioned in spaced relationship from the web portion 29 that is to be registered with a particular reference point 170 in an operating station 70 is illustrated In FIG. 2. In such a situation, a reference signal indicative of the passage of web portion 29 at a reference point 170 is generated by counting web encoder pulses after each indicia sensing pulse up to a total distance value equal to the distance between sensing station position 121 and operating station reference position 170 plus the distance between the portion of the web 29 to be registered and the associated register indicia 11 wherein the distance between 11 and 20 is treated as having a positive value if 29 is upstream of 11 and is treated as having a negative value if, as in the illustrated embodiment, web reference portion 29 is positioned downstream of register indicia 11.

Figure 5:
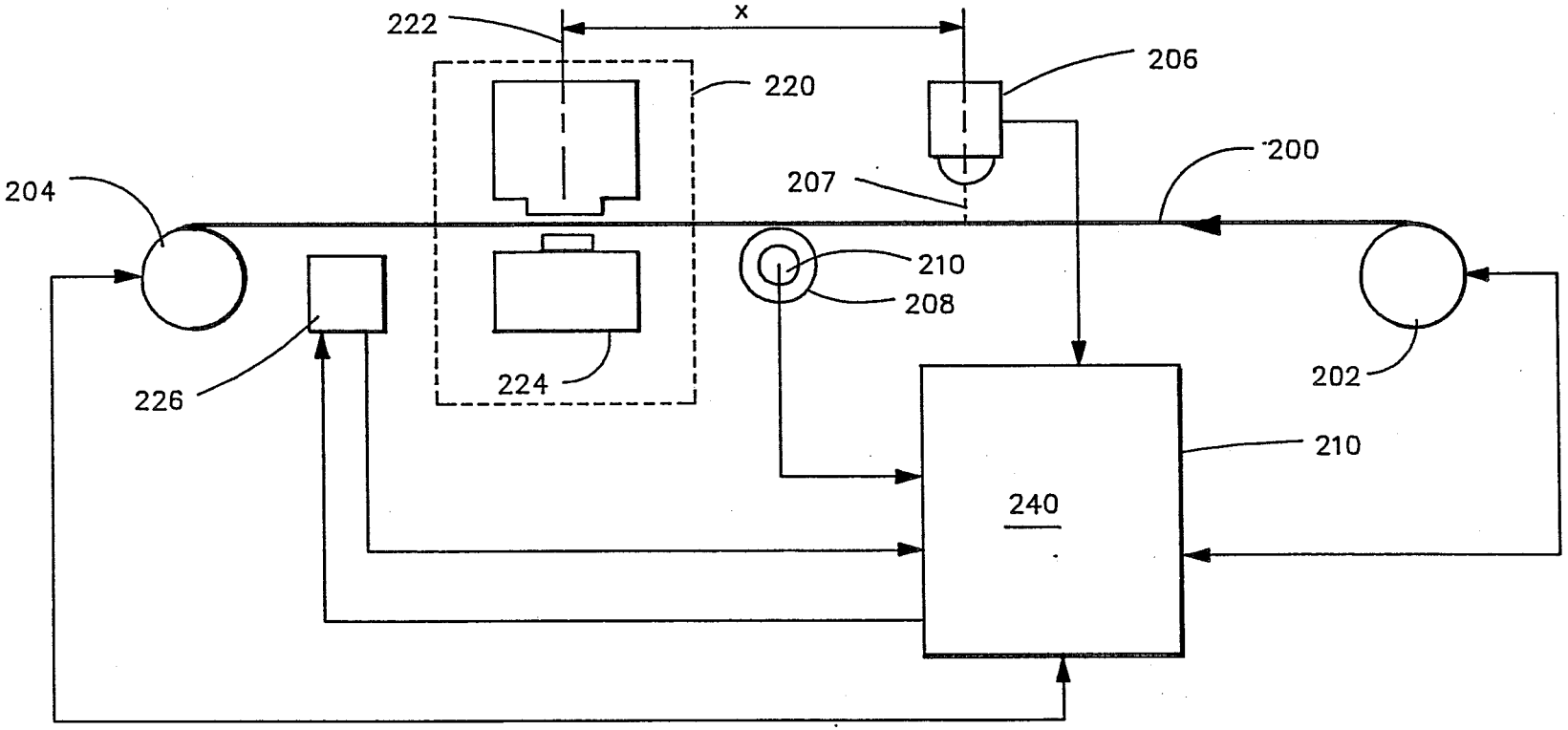
FIG. 5 is a schematic illustration of another embodiment of a continuous web and operating stations used in processing thereof in which the control system of the present invention is utilized.

Another embodiment of the invention is illustrated in FIG. 5 in which a web 200 mounted between a driven unwind roll 202 and a driven wind up roll 204 passes through an operating station 220 at which material is sprayed onto a selected portion of each repeat length of the passing web. The web 200 may have the same configuration as web 20 illustrated in FIG. 2 and is moved at a relatively constant velocity between roll 202 and 204. Operating station reference position 222 is selected as the position at which a spray nozzle is positioned which sprays a small area web portion located at 11 when the web is properly phased.

An indicia sensing unit 206 is positioned at 207 at a known distance x which in one embodiment is five ideal repeat lengths of web travel upstream of operating station reference position 222 and generates a reference pulse each time a web indicia 11 is sensed. An operating station pumping unit 224 periodically discharges spray at reference position 222 at a normally constant rate which is dependent in the speed of operation of drive motor 226. Motor 226 provides a spray discharge reference signal to a computer 240 which also receives reference signals from web indicia sensing unit 206, web encoder 208, and a speed signal from driven rolls 202, 204. Computer 240 generates a web indicia reference signal having pulses produced after each detection pulse from sensing unit 206 occurring after counted encoder pulses from encoder 210 indicate that a distance of web travel equal to x has occurred. This reference signal is compared to the signal from 226 for determining the amount of phasing error in the system. Repeat length error is determined in the same manner as described above and a total error value is computed by adding the phasing error to the repeat length error associated with the incoming repeat length. In one control mode, the computer 240 produces a control signal to temporarily vary the speed of rolls 202, 204 to correct any detected total error value by varying web speed. In another control mode, computer 240 produces a control signal to temporarily vary the frequency of operation of pumping unit 224 by varying the speed of motor 226 to phase the operating station to the web 200.

It is contemplated that the inventive concepts herein described may be variously otherwise embodied and it is intended that the appended claims be construed to include alternative embodiments of the invention except insofar as limited by the prior art.

What is claimed is:

1. A method for controlling the phasing or repeat length portions of a moving web to an operating machine located at an operating station along the web wherein the operating machine has a repeating operating cycle and is designed to perform the same operation at the same relative position within each repeat length portion of the web passing through the operating station and wherein the web is of the type which is subject to minor variations in the length of the repeat length portions thereof, comprising:

(a) providing register indicia on the web in association with each repeat length;

(b) sensing the passage of a web register indicia at a predetermined sensing location upstream of the operating station;

(c) continuously measuring the distance of web travel occurring after the sensing of said register indicia at said sensing station and at frequent intervals determining the relative distance of said sensed register indicia from an operating station registration position based upon said measured distance;

(d) monitoring the relative cyclical position of said operating machine;

(e) comparing said monitored cyclical machine position with said determined register indicia position at frequent intervals during the last repeat length distance of web travel before said register indicia reaches said operating station registration position;

(f) adjusting the relative velocity between the movement of said web and the cyclical movement of the operating machine at frequent intervals during said last repeat length distance of movement of said register indicia based upon said comparison of machine position and register indicia position at frequent intervals during said last repeat length distance of movement of said register indicia so as to position said register indicia at said operating station registration position at the same time as the occurrence of a predetermined cyclically repeating machine operating position.

2. A method for controlling the phasing or repeat length portions of a moving web to an operating machine at an operating station along the web wherein the operating machine has a cyclically repeating operating cycle and is designed to perform the same operation at the same relative postion within each repeat length portion of the web passing through the operating station and wherein the web is of the type which is subject to minor variations in the length of the repeat length portions thereof, comprising:

(a) providing register indicia on the web in associatiton with each repeat length;

(b) sensing the passage of each register indicia at a sensing station located a predetermined distance of web travel upstream from an indicia registration point in said operating station associated with a predetermined, cyclically reoccurring operating machine state and generating a register indicia sensing signal indicative of the sensing of register indicia at said sensing station;

(c) providing a web travel signal indicative of the distance of web travel;

(d) determining the point in time at which a register indicia is coincident with said operating station registration point by determining the point in time at which the web travel distance occurring after the sensing of an indicia at said sensing station is equal to said predetermined web travel distance between said sensing station and said operating station registration point through the use of said sensing signal and said web travel signal and generating a web indicia registration signal having signal pulses indicative of said coincidence between a web register indicia and said operating station registration point;

(e) continuously monitoring the relative cyclical state of said operating machine including monitoring the occurrence of a machine reference state which occurs at the time a register indicia is located in coincidence with said operating station reference point during proper registration of said web and said operating machine;

(f) determining the web phasing error distance associated with each repeat length portion of the web by measuring the distance of web travel occurring between the occurrence of a registration signal pulse indicative of the point in time of coincidence between a register indicia and the operating station registration point, and the point in time of the occurrence of said machine reference state;

(g) determining the length of each repeat length portion at a position upstream of said operating station by determining the distance of web travel occurring between a first sensed indicia and the next sensed indicia using said indicia sensing signal and said web travel signal;

(h) determining the repeat length error distance associated with each repeat length portion of the web by comparing the measured repeat length distance thereof to a predetermined design repeat length value and calculating the difference;

(i) determining the total web travel adjustment needed for proper phasing of a repeat length portion with the operating machine when the repeat length portion is positioned one repeat length upstream of the operating station by adding the repeat length error distance associated with the immediately preceding repeat length portion to the phasing error distance associated with the immediately preceding repeat length portion;

(j) adjusting the speed of the web relative the speed of the operating machine to provide said web travel adjustment.

3. The invention of claim 2 wherein step (j) comprises monitoring the relative amount of web travel adjustment that has been made at frequent intervals during the last repeat length of web travel upstream of the operating machine and adjusting web speed in relatively small increments during said last repeat length of web travel to provide an accurate and relatively constant rate speed adjustment of said web during said last repeat length of web travel whereby said web is not subjected to substantial inertial forces.

4. Apparatus for controlling the phasing of repeat length portions of a moving web to an operating machine at an operating station along the web wherein the operating machine has a repeating operating cycle and is designed to perform the same operation on each repeat length portion of the web pasing through the operating station and wherein the web is of the type which is subject to minor variations in the length of the repeat length portions thereof, comprising:

(a) register indicia means associated with each repeat length portion of the web positioned at a substantially identical location within each repeat length portion of the web for sensing by a register indicia sensing means for indicating the relative position of an associated repeat length portion;

(b) register indicia sensing means positioned at a sensing station along the web at a preselected distance of web travel upstream of the operating station for sensing the passage of said register indicia at said sensing station and for providing a register indicia sensing signal indicative of the occurrence of said machine reference position;

(c) web travel monitoring means operatively associated with the web for providing a web travel signal indicative of web travel distance;

(d) machine reference position sensing means for sensing the occurrence of a cyclically repeating preselected reference position of said operating machine, said reference position being selected to occur in a predetemined relationship with the occurrence of the coincidence of a web reference indicia and a preselected reference point in said machine operating station when the associated web repeat length portion is in phase with said operating machine, and for providing a machine position reference signal indicative thereof;

(e) operating machine movement sensing means for providing a machine movement signal indicative of the relative cyclical machine movement of said operating machine;

(f) data processing means for receiving and processing said web register indicia sensing signal, said web travel signal, said machine reference position signal, and said machine movement signal and for generating a control signal for controlling the relative rate of movement between said web and said operating machine based on said processing of signals for placing each repeat length portion of the web in proper registry with said operating machine wherein said data processing means comprises;

web repeat length calculating means for calculating the length of each repeat length portion of the web prior to its passage through the operating station;

repeat length error determining means for comparing said calculated length of each repeat length portion to a predetermined, constant, design repeat length value for determining the relative repeat length error occurring in each repeat length portion;

register indicia reference signal generating means for generating a signal indicative of the passage of a register indicia past said preselected reference point in said operating station which is located at a predetermined distance of web travel downstream of said indicia sensing means;

phasing error determining means for comparing said register indicia reference signal to said machine position reference signal for measuring the phasing error between a web repeat length portion and the operating machine during each operating machine cycle;

error summing means for summing a determined phasing error associated with the repeat length portion located at the operating station with a determined repeat length error associated with the repeat length portion located at the operating station for determining an initial total error value for the repeat length portion immediately upstream of the operation station which is representative of the distance by which said immediately upstream repeat length portion is out of phase with said operating machine at a point in time when it is positioned approximately one repeat length upstream of said operating station;

wherein the control signal generated by said data processing means is based upon said determined total error value associated with the repeat length portion immediately upstream of the operating station.

5. The invention of claim 4 wherein said data processing means monitors and compares at frequent monitoring intervals said web travel signal and said machine motion signal during the movement of a web repeat length portion from a position approximately one repeat length upstream of the operating station to a position associated with machine registry in said operating station whereby the relative amount of correction of said total initial error value which has been accomplished as said repeat length portion moves toward said operating station is calculated at frequent intervals; and wherein said control signal is adjusted at frequent intervals as said repeat length portion moves toward said operating station based upon said relative amount of correction of said initial total error value which has been accomplished after each said monitoring interval.

6. The invention of claim 5 wherein the frequency of said control signal adjustments are at least two times per linear inch of web travel.

7. The invention of any of claims 4–6 wherein:

said register indicia sensing means comprises a photo eye assembly;

said web trvel monitoring means comprises a high resolution encoder;

said machine reference position sensing means and said operating machine movement sensing means comprises a high resolution encoder; and said data processing means comprises a digital computer.

8. Apparatus for controlling the phasing of repeat length portions of a moving web to an operating machine at an operating station along the web wherein the operating machine has a repeating operating cycle and is designed to perform the same operation on each repeat length portion of the web passing through the operating station and wherein the web is of the type which is subject to numerous minor variations in length of the repeat length portions thereof from a design repeat length, comprising:

(a) instantaneous phasing error measuring means for measuring the phasing error between the operating machine and a web repeat length portion upon which an operation is performed which exists at the occurrence of a preselected, cyclically repeating, reference position of the operating machine;

(b) repeat length error measuring means for measuring the deviation of the actual length of a repeat length portion of the web from the design repeat length at a position upstream of said operating station;

(c) total phasing deviation determining means for adding the mesured phasing error of the repeat length portion currently located at the operating station and the measured repeat length error of the repeat length portion currently located at the operating station for determining the total distance by which the next succeeding repeat length portion of the web is out of phase with the operating machine at a time when the next succeeding repeat length portion is positioned approximately one repeat length distance of web travel upstream of the machine operating station;

(d) phasing correction response means for making a phasing correction during the period when said next succeeding repeat length portion is traversing the last repeat length distance of web travel upstream of said operating station by variation in the relative speed between the operating machine and the web in response to said determined sum of said instantaneous phasing error and associated repeat length error for placing said next succeeding repeat length portion in registry with said operating machine.

9. The invention of claim 8 further comprising:

phasing correction response monitoring and adjustment means for monitoring and adjusting the phasing correction being made by said phasing correction response means during the period that the subject phasing correction is being made.

* * * * *